US009085943B2

(12) United States Patent
Owens

(10) Patent No.: US 9,085,943 B2
(45) Date of Patent: Jul. 21, 2015

(54) PIPE HANDLING DEVICE

(71) Applicant: George Ronald Owens, Key Colony Beach, FL (US)

(72) Inventor: George Ronald Owens, Key Colony Beach, FL (US)

( * ) Notice: Subject to any disclaimer, the term of this patent is extended or adjusted under 35 U.S.C. 154(b) by 58 days.

(21) Appl. No.: 13/732,350

(22) Filed: Dec. 31, 2012

(65) Prior Publication Data

US 2014/0186143 A1 Jul. 3, 2014

(51) Int. Cl.
*E21B 19/14* (2006.01)
*E21B 19/15* (2006.01)

(52) U.S. Cl.
CPC ..... *E21B 19/146* (2013.01); *E21B 19/15* (2013.01)

(58) Field of Classification Search
USPC ..... 166/77.51; 175/52, 85; 211/163, 70, 211/70.4; 221/122; 414/22.51–22.59, 414/22.61–22.69, 22.71
See application file for complete search history.

(56) References Cited

U.S. PATENT DOCUMENTS

| | | | | |
|---|---|---|---|---|
| 1,693,086 | A * | 11/1928 | Laird | 221/122 |
| 3,157,286 | A * | 11/1964 | Gyongyosi | 211/1.53 |
| 3,181,630 | A * | 5/1965 | Coburn | 175/85 |
| 3,336,991 | A * | 8/1967 | Klem et al. | 175/85 |
| 4,214,445 | A * | 7/1980 | Winsor et al. | 60/486 |
| 4,445,579 | A * | 5/1984 | Bello | 175/52 |
| 5,397,005 | A * | 3/1995 | Taccolini | 211/70 |
| 6,298,927 | B1 * | 10/2001 | Back | 175/52 |
| 6,543,555 | B2 * | 4/2003 | Casagrande | 175/85 |
| 2009/0196712 | A1 * | 8/2009 | Mortensen et al. | 414/22.68 |
| 2010/0104401 | A1 * | 4/2010 | Hopkins et al. | 414/22.54 |

FOREIGN PATENT DOCUMENTS

| | | | | |
|---|---|---|---|---|
| JP | 04108992 | A * | 4/1992 | E21B 19/20 |

OTHER PUBLICATIONS

Stephen Mraz, "Speed valve completes full-force regenerative hydraulic circuit", published on Aug. 9, 2001 at http://machinedesign.com/archive/speed-valve-completes-full-force-regenerative-hydraulic-circuit, pp. 1-4.*

* cited by examiner

*Primary Examiner* — Gregory Adams

(57) ABSTRACT

A pipe handling system reduces the amount of physical effort required for an operator to transfer steel rotary drilling pipe sections from a storage location to and from a rotary drive unit. The system utilizes an indexing arm which removes or adds the pipe sections from the storage location, placing them in the correct position to be attached to or removed from the rotary drive unit. The index arm, unlike other systems, can remove individual pipe sections to and from the storage location directly to the rotary drive unit's centerline of drilling position. This reduces both the number of physical moves required to complete the task and the amount of weight being transferred. The indexing arm is able to lift a pipe section from the storage location and place it below the rotary drive unit's centerline, then lower away from it without additional movement of the rotary drive unit itself.

4 Claims, 4 Drawing Sheets

FIG. 4
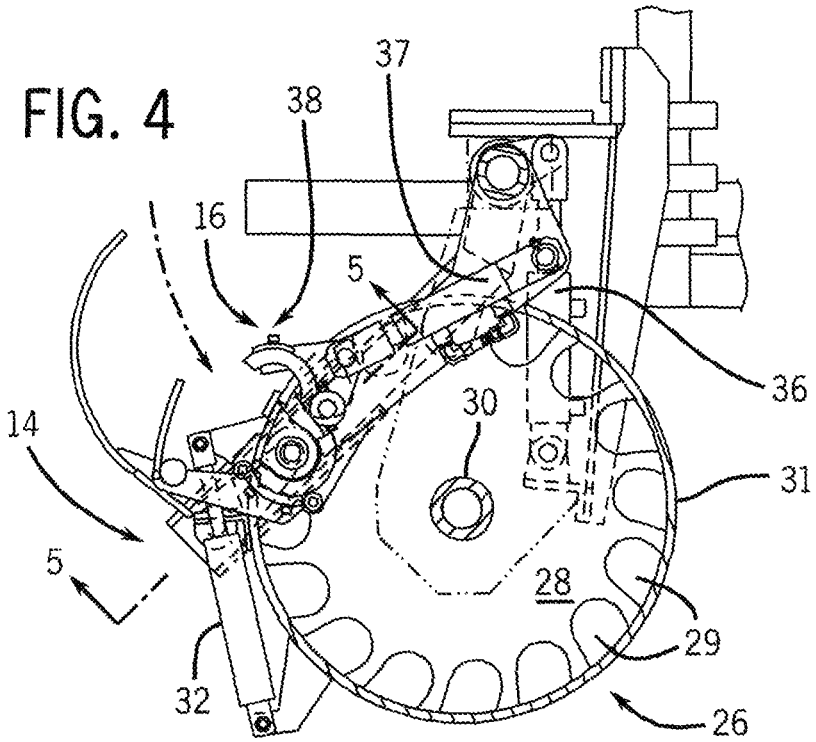
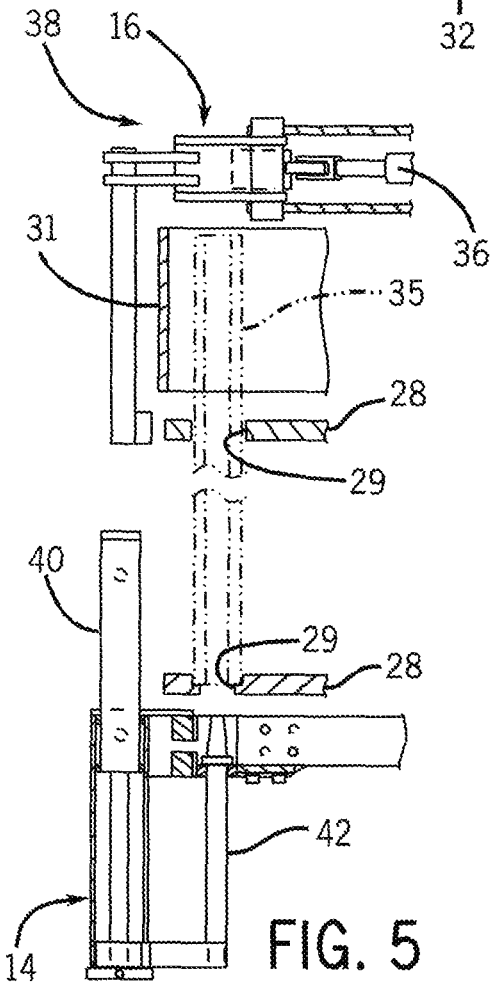
FIG. 5
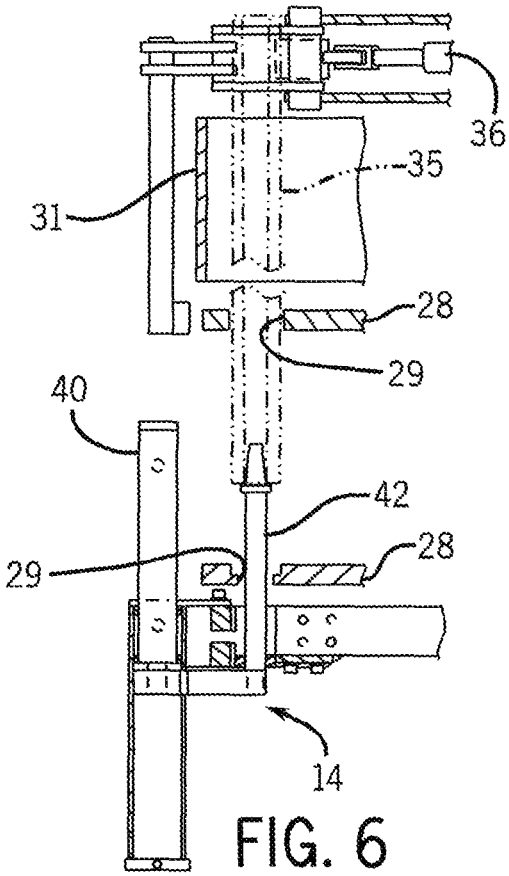
FIG. 6

FIG. 7
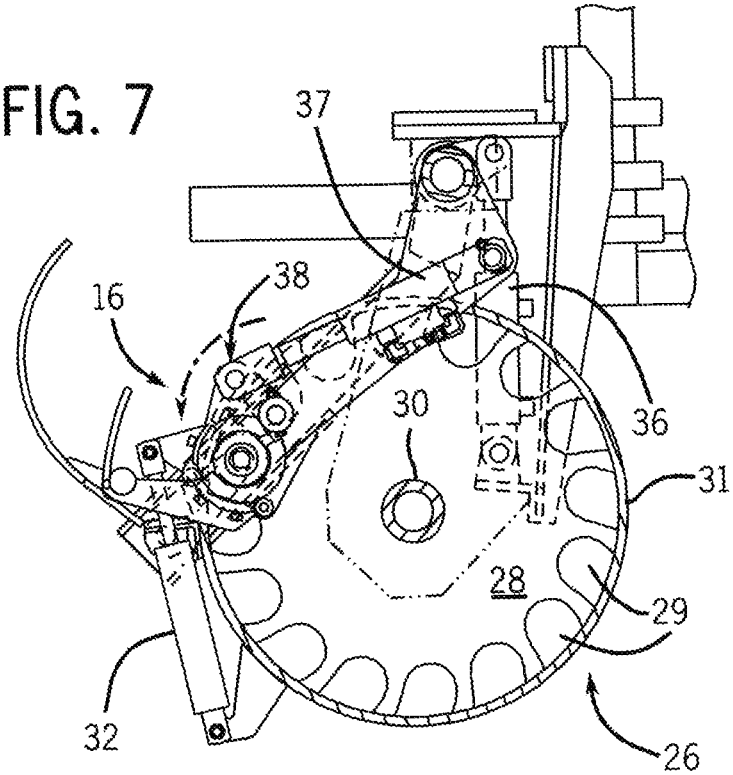
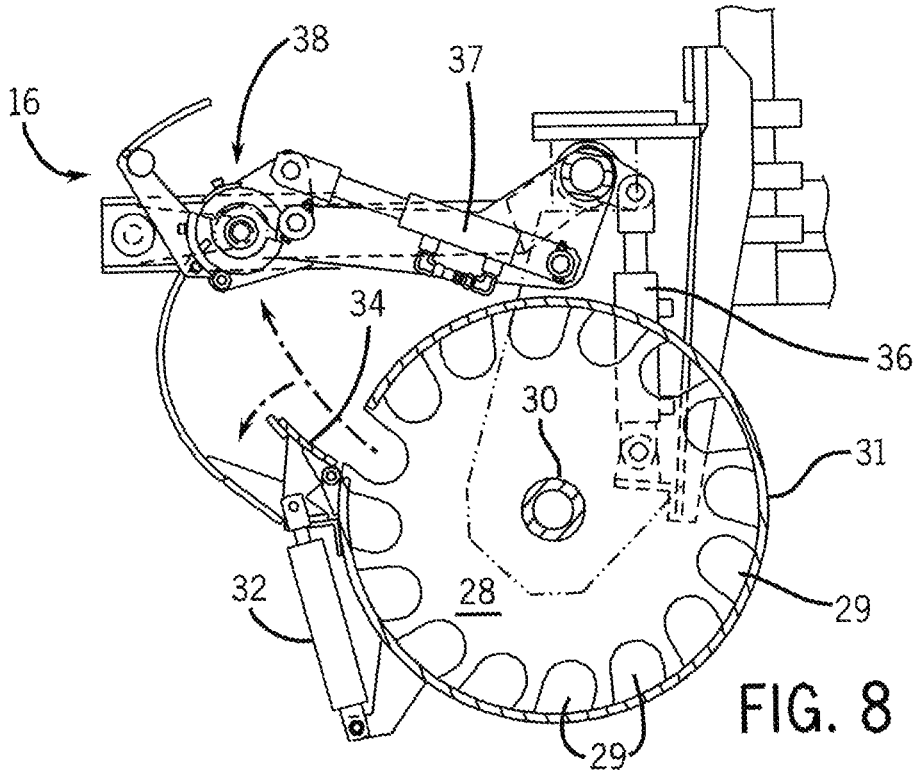
FIG. 8

PIPE HANDLING DEVICE

BACKGROUND OF THE INVENTION

The present invention relates to pipe handling devices and, more particularly, to semi-automatic reloadable rotary drill pipe storage and indexing system.

A significant amount of physical effort is expended for operators to transfer steel rotary drilling pipe sections from a storage location to and from a rotary drive unit.

Some conventional systems require the rotary drive unit to move the rotary drill pipe storage location, which involves additional physical effort to achieve the steps required as well as increased wear on moving parts.

Other conventional systems move the total number of rotary pipe sections located in the storage container all at once to the rotary drive unit. This method also involves several independent steps and requires moving the total weight of the storage container instead of one single drill pipe section at a time. This results in accelerated wear patterns on moving parts, changes in center of weight distribution and safety concerns due to the amount of weight being transferred in one movement.

As can be seen, there is a need for an improved pipe handling device that can safely and effectively move pipe sections as needed.

SUMMARY OF THE INVENTION

A semiautomatic rotary drill pipe handling system attached directly to a rotary drilling rig mast which stores multiple pipe lengths and incorporates an indexing arm with positioning and securing capabilities that enable it to relocate lengths of pipe from a storage location directly to the centerline drilling position of the rotary drive unit.

One aspect of this invention is that the pipe lengths are already in the vertical position as is the rotary drilling mast when in the drilling position.

The index arm's ability to relocate the pipe lengths from the storage location directly to the rotary drive unit's centerline simplifies the task and is significantly different from other approaches.

Another aspect of the invention is the ability to transfer the lengths of pipe to the drilling position and back to the storage location without having to move the rotary drive unit side to side or up and down in extra moves to add or remove the lengths of pipe from the rotary drive unit.

A distinct feature of the invention is that once the length of pipe has been added to the rotary drive unit, the index arm can be relocated back to the storage location without additional movement of the rotary drive unit.

Another distinct feature is the ability to reload the storage unit with additional lengths of pipe after the original number of pipe sections have been utilized.

These and other features, aspects and advantages of the present invention will become better understood with reference to the following drawings, description and claims.

BRIEF DESCRIPTION OF THE DRAWINGS

FIG. 4 is a detailed top view of the pipe handling device of FIG. 1, illustrating an index arm assembly being moved to retrieve a length of pipe;

FIG. 5 is a side view of the pipe handling device of FIG. 1, illustrating a lift arm assembly in position under a length of pipe and a clamp arm assembly above the length of pipe;

FIG. 6 is a side view of the pipe handling device of FIG. 1, illustrating the lift arm assembly lifting a length of pipe, and the clamp arm securing the length of pipe;

FIG. 7 is a detailed top view of the pipe handling device of FIG. 1, illustrating the index arm assembly ready to remove a length of pipe;

FIG. 8 is a detailed top view of the pipe handling device of FIG. 1, illustrating a pod gate being opened and the index arm assembly removing a length of pipe from the pod.

DETAILED DESCRIPTION OF THE INVENTION

Figure 1:
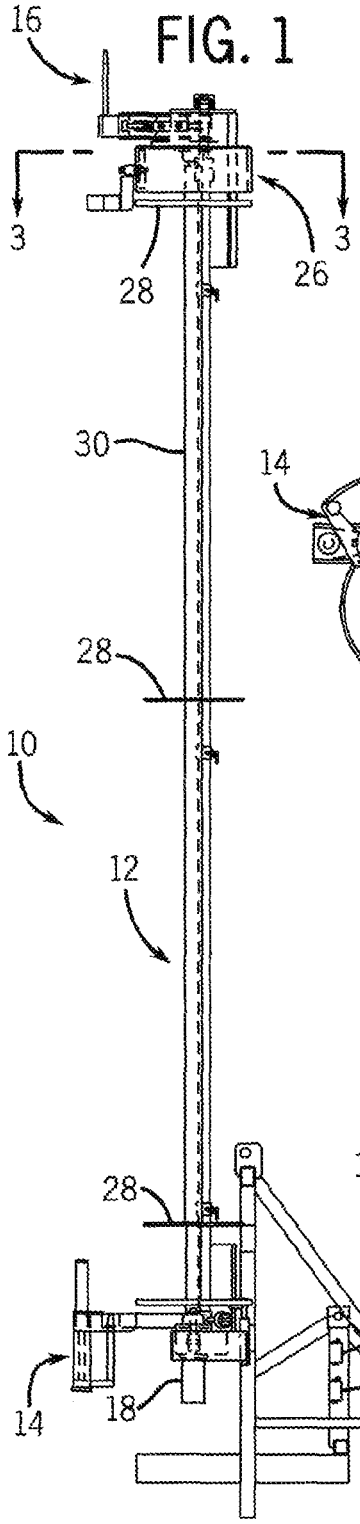
FIG. 1 is a side elevation view of a pipe handling device according to an exemplary embodiment of the present invention.
Figure 2:
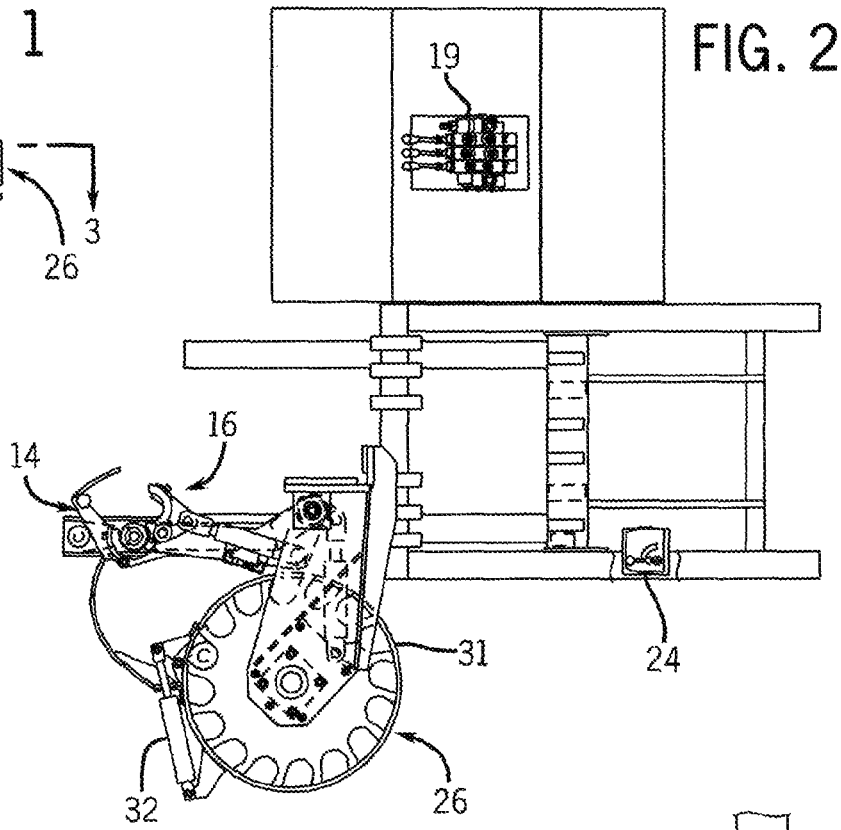
FIG. 2 is a top view of the pipe handling device of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a pipe handling system that reduces the amount of physical effort required for an operator to transfer steel rotary drilling pipe sections from a storage location to and from a rotary drive unit. The system utilizes an indexing arm which removes or adds the pipe sections from the storage location, placing them in the correct position to be attached to or removed from the rotary drive unit. The index arm, unlike other systems, can remove individual pipe sections to and from the storage location directly to the rotary drive unit's centerline of drilling position. This reduces both the number of physical moves required to complete the task and the amount of weight being transferred. The indexing arm is able to lift a pipe section from the storage location and place it below the rotary drive unit's centerline, then lower away from it without additional movement of the rotary drive unit itself.

Referring now to FIGS. 1 through 9, a pipe handling device 10 is configured to remove pipe sections 35 from a storage pod carousel assembly 26 and move individual pipe sections 35 to and from a rotary drive unit 43.

A control valve 19 can be used to energize a lift clamp valve 20 and a gate swing valve 22, resulting in the activation of a lift arm assembly 14, a clamp arm assembly 16, a swing cylinder 36 and a pod gate 34, which enables an index arm assembly 12 to move individual drill pipe sections 35 to and from the storage pod carousel assembly 26. The control valve 19 can be used to energize a pod positioner 18, whose speed is controlled by a pod speed valve 24. The pod positioner 18 can be stopped at an appropriate position to position a pipe section 35 to be moved by the index arm assembly 12.

The lift arm assembly 14 and the clamp arm assembly 16 are attached to the index arm 12 and can work in conjunction to remove and secure the individual pipe section 35 from the storage pod carousel assembly 26. The index arm 12 is then used to relocate the pipe section 35 from a fixed position in a carousel station 29 in a carousel unit 28 of the storage pod carousel assembly 26, to a centerline of the rotary drive unit. A carousel guard 31 can be disposed to retain the pipe sections 35 in their respective carousel stations 29 until use.

To use the pipe handling device of the present invention, the operator activates the control valve 19 to activate the lift-clamp valve 20 to remove a rotary pipe section 35 from the storage pod carousel assembly 26. When the operator is ready to load the pipe section 35 onto the rotary drive unit, they can activate the gate-swing valve 22 which moves the index arm 12 with the pipe 35 to a centered position beneath the rotary drive unit. The operator can then activate a pod speed valve 24, which repositions the storage pod carousel assembly 26 upon a central shaft 30 so that the index arm 12 can be reactivated so as to repeat the task.

By performing the above described operation in reverse, the operator can remove the rotary drill pipe sections from the rotary drive units drilling position centerline and put them back into the storage pod carousel assembly 26.

Figure 3:
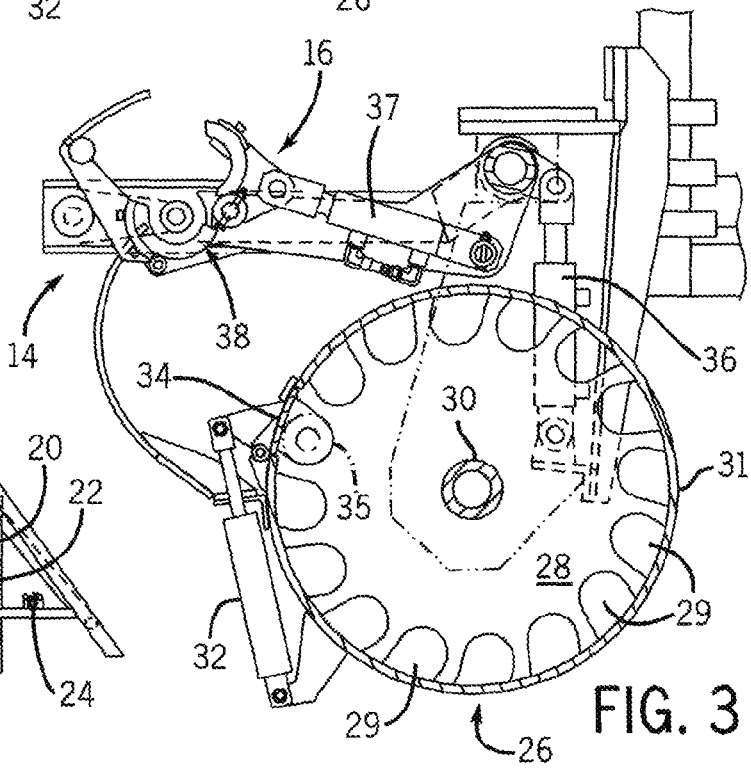
FIG. 3 is a detailed top view of the pipe handling device of FIG. 1.
Figure 9:
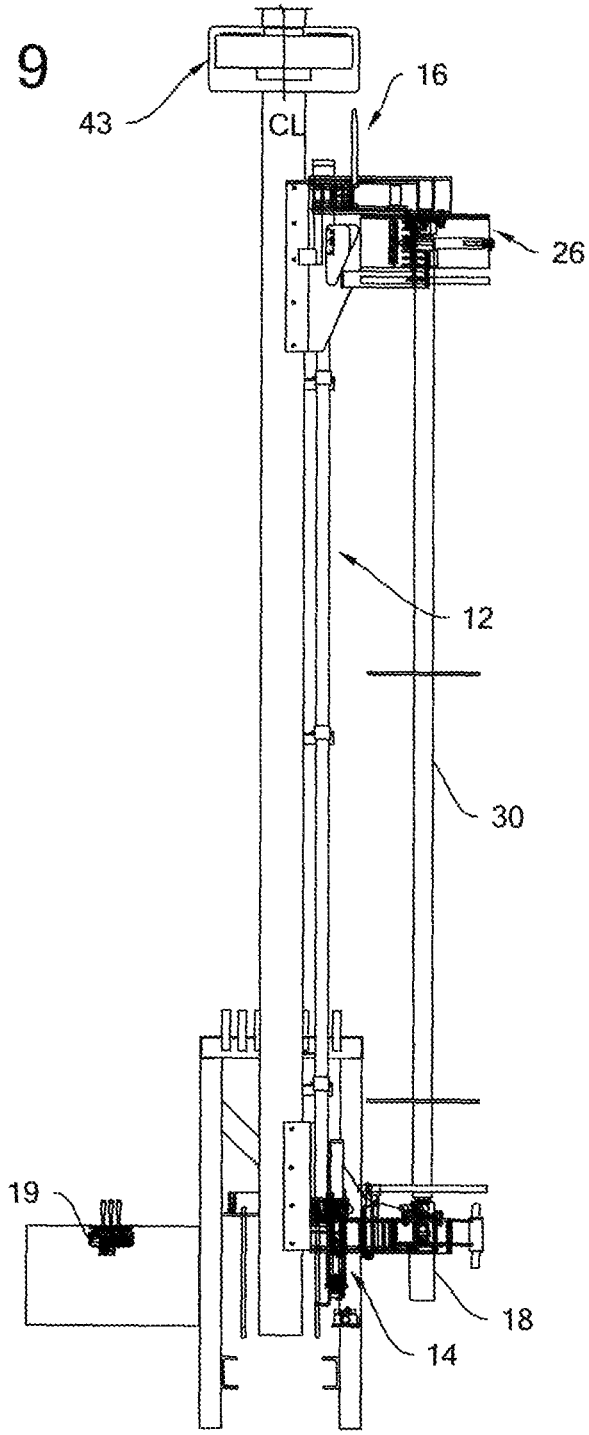
FIG. 9 is a side elevation view of the pipe handling device of FIG. 1.

Referring specifically to FIG. 3, a pipe section 35 is shown in one of the carousel stations 29. The index arm 12 can move the lift arm 14 and clamp arm 16 into position, as shown in FIG. 4, so that when the lift cylinder 40 shown in FIG. 5 raises the pipe lifting rod 42 which lifts the pipe section 35 as shown in FIG. 6, the clamping cylinder 37 closes the clamping unit 38 around the pipe section 35 as shown in FIG. 7. The pod gate cylinder 32 opens the pod gate 34 and the swing cylinder 36 which is attached to the index arm 12 moves the lift arm 14 and clamp arm 16 holding the pipe section 35 to the rotary drive units centerline position as shown in FIG. 8.

It should be understood, of course, that the foregoing relates to exemplary embodiments of the invention and that modifications may be made without departing from the spirit and scope of the invention as set forth in the following claims.

What is claimed is:

1. A pipe handling device comprising:

a carousel assembly having a plurality of carousel stations operable to contain a pipe therein;

a carousel guard operable to retain the pipe in the carousel stations of the carousel assembly;

a carousel assembly positioner operable to move the carousel assembly to a desired location;

a carousel station gate operable to permit access into and out of the carousel station by the pipe;

an index arm assembly operable to remove a pipe from the desired location and move the pipe to a use location;

a lift arm assembly operable to lift the pipe prior to being removed by a clamp arm assembly;

a clamping cylinder operable to open and close a clamping unit of the clamp arm assembly; and a swing cylinder operable to swing the index arm assembly to move the pipe to the use location.

2. The pipe handling device of claim 1, further comprising a gate swing valve operable to open and close the carousel station gate.

3. The pipe handling device of claim 1, further comprising a speed valve operable to control the carousel assembly positioner.

4. The pipe handling device of claim 1, further comprising:

a lifting rod; and a lifting cylinder operable to move the lifting rod up and down, lifting the pipe up and being secured by the clamping unit prior to removal from the carousel station.

* * * * *